US007617713B2

(12) United States Patent
Zelin

(10) Patent No.: US 7,617,713 B2
(45) Date of Patent: Nov. 17, 2009

(54) FINAL DIE FOR WIRE DRAWING MACHINES

(75) Inventor: Michael Gregory Zelin, Canal Fulton, OH (US)

(73) Assignee: The Goodyear Tire + Rubber Company, Inc., Akron, OH (US)

( * ) Notice: Subject to any disclaimer, the term of this patent is extended or adjusted under 35 U.S.C. 154(b) by 235 days.

(21) Appl. No.: 11/011,891

(22) Filed: Dec. 14, 2004

(65) Prior Publication Data

US 2006/0123876 A1 Jun. 15, 2006

(51) Int. Cl.
*B21C 3/00* (2006.01)
*B21C 1/02* (2006.01)

(52) U.S. Cl. ..... 72/467; 72/274

(58) Field of Classification Search ..... 72/467, 72/282, 278, 253.1, 271, 274
See application file for complete search history.

(56) References Cited

U.S. PATENT DOCUMENTS 2,109,312 A * 2/1938 Dimmick ..... 72/463
3,299,687 A * 1/1967 Kneip, Jr. et al. ..... 72/278
3,879,973 A * 4/1975 Godyn et al. ..... 72/37
4,270,373 A * 6/1981 Hirato et al. ..... 72/41
5,189,897 A * 3/1993 Lionetti et al. ..... 72/278
5,511,440 A * 4/1996 Watanabe et al. ..... 74/492
5,535,612 A 7/1996 Vijayakar
6,082,163 A * 7/2000 Hara ..... 72/280
6,106,637 A 8/2000 Arnaud et al.
6,430,980 B1 * 8/2002 Weinhold et al. ..... 72/43
7,188,418 B2 * 3/2007 Shah ..... 29/890.05

FOREIGN PATENT DOCUMENTS

JP 2001088506 A 3/2001

OTHER PUBLICATIONS

Ultra-Smoothing Bar and Wire by Drawing Process with Protrusion Die by Motoo Asakawa, et al. No of Pages 24.

* cited by examiner

*Primary Examiner*—Dana Ross
*Assistant Examiner*—Debra M Sullivan
(74) *Attorney, Agent, or Firm*—Roger D. Emerson; Daniel A. Thomson; Emerson, Thomson & Bennett LLC

(57) ABSTRACT

A wiredrawing machine includes dies and capstans for reduces the cross sectional area of the wire. The machine includes a double die situated at the last capstan to reduce the cross sectional wire one final time in such a way that delamination and central bursting is minimized.

16 Claims, 3 Drawing Sheets

FINAL DIE FOR WIRE DRAWING MACHINES

BACKGROUND OF THE INVENTION

1. Field of Invention

This invention pertains to the art of methods and apparatuses for wet wiredrawing machines, and more specifically to a final double die used with the wet wiredrawing machines.

2. Brief History

While the invention is subject to a wide range of applications, it is particularly suited for drawing metal wire into high tensile strength, steel wire with increased torsional ductility. In particular, wire is drawn through a plurality of dies in a wire drawing machine whereby the cross section of the wire is reduced by a constant reduction at each die. The total reduction at the final two dies is generally equal to the constant reduction.

The hardness of drawn steel wire results from the plastic deformation associated with the drawing process. The wire increases in hardness as it proceeds through the wire drawing machine. If the wire becomes too hard or brittle, breakage occurs during the drawing process or when the wire is subjected to torsion or bending.

As the wire is drawn through a die to reduce its cross section, the outer fibers of the wire flow faster or at a higher velocity than those in its center causing a lesser amount of elongation at the center of the wire than at the surface of the wire. A stress differential resulting from this mechanism of elongation induces compressive, longitudinal stresses on the surface of the wire and tensile, longitudinal stresses at its center. Voids, known as central bursts, can occur in the center of the wire when the tensile stresses exceed the breaking strength of the material. The central burst effect can be prevented by controlling the process geometries, such as the die angle and the percent reduction in area. The central bursting zone defines die geometries for which non-uniform deformation through the cross section of the wire is expected. Die geometries defining the central bursting zone do not always result in central bursting. These geometries will, however, always induce the tensile, longitudinal stresses in the wire center and the compressive, longitudinal stresses at the wire surface that can cause voids and fracture during subsequent drawing steps or when the drawn wire is subjected to torsional loading.

Strain introduced into the wire by the drawing process increases the tensile strength of the wire. Preferably, this increase is held constant at every die of the draft in a wire drawing machine. Analyses of the formation of central bursts show that bursting is more likely to occur if the increase in tensile strength remains low. Therefore, the wire is drawn through a draft of many dies each having geometry to avoid the central burst zone. Reducing the number of dies in the draft results in a higher reduction of area at each die. This in turn results in an increase in both heat generation and die wear.

Ductility of high strength, steel wire is particularly important when the wire is subjected to plastic deformation during manufacture, such as from twisting a plurality of wires into a multi-wire strand. Torsion testing, indicating the minimum number of twists to failure, is a common method of testing wire ductility. Maximum ductility occurs when there is uniform twisting along a gauge length and the final fracture is straight and transverse to the wire axis. Strain localization and delamination (longitudinal splitting) are qualitative indications of a decrease in ductility.

SUMMARY OF THE INVENTION

It is desirable to provide a method and apparatus to draw high tensile strength, steel wire that has increased torsional ductility.

It is a further advantage of the present invention to provide an apparatus and method of drawing steel wire to produce high tensile strength, steel wire with increased torsional ductility.

It is a still further advantage of the present invention to produce high tensile strength, steel wire with increased torsional ductility by a relatively inexpensive method and apparatus.

In accordance with the invention, there is provided method and apparatus for drawing steel wire through a plurality of dies and drawing capstans alternately arranged in a wire drawing machine. The cross section of the wire is typically reduced by a reduction of about 15% to about 18% at each of the dies. The cross section of the wire at the final double die is reduced by a total amount substantially equal to the reduction at a single standard die.

In accordance with the present invention, a method of drawing steel wire to produce high tensile strength comprises the steps of drawing wire through a plurality of dies arranged in a wire drawing device; reducing the cross section of the wire by a constant reduction of about 15% to about 18% at each of the plurality of dies; and reducing the wire at a final double die by a total amount is equal or less than the constant reduction of the previous dies.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
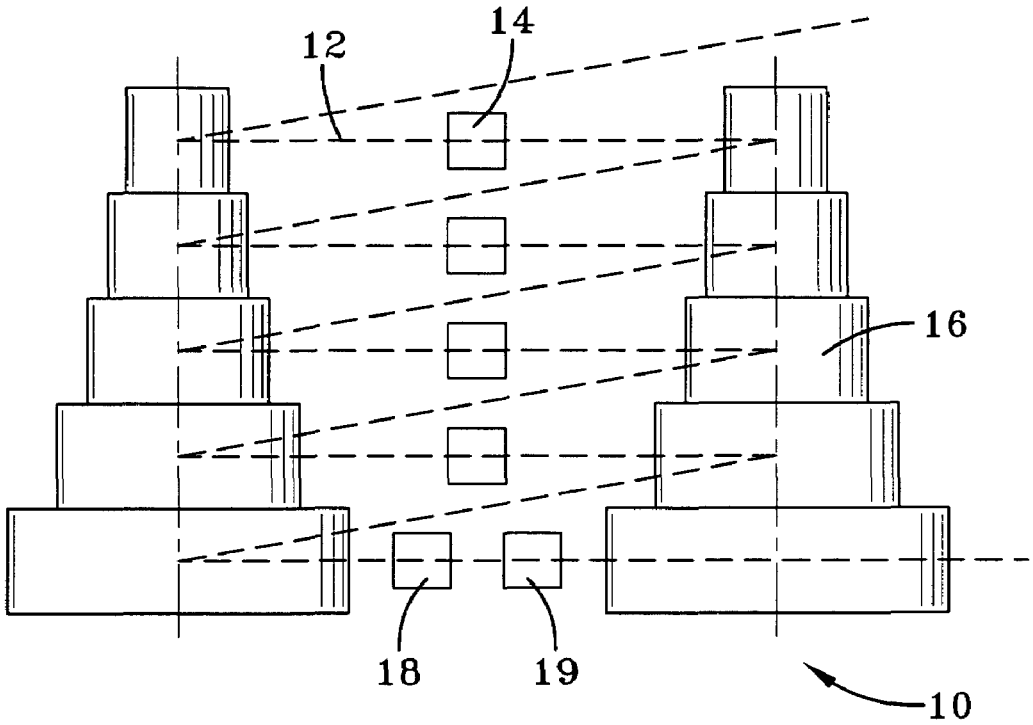
FIG. 1 is a schematic of drawing capstans and dies for drawing metal wire of the present invention.

Referring now to the drawings wherein the showings are for purposes of illustrating a preferred embodiment of the invention only and not for purposes of limiting the same, FIG. 1 depicts a wire drawing device 10 that produces high tensile strength wire 12, which may be steel wire. A plurality of substantially identical, standard dies 14 and drawing capstans 16 are alternately arranged in device 10. The term "standard die" refers to a die having a geometry that reduces the cross section of the wire passing through one conical region of the die. A final die is included at the end of the device that includes multiple wire reduction components, to be discussed in detail in a subsequent paragraph, such that the total reduction of the cross section of the wire at the final die 18 and 19 of the device 10 is equal or less than the reduction at each of the preceding, standard dies. In one embodiment, the device 10 is preferably a wet slip wire drawing machine 10 and the dies may be submerged in a cooling lubricant for use in dissipating heat.

With continued reference to FIG. 1, the wire 12 may be brass-coated and/or zinc-coated steel wire or filaments. The steel filaments may have a very thin layer of brass, such as alpha brass, with the brass coating itself having a thin zinc layer thereon, or a ternary alloy addition, such as cobalt or nickel. The term "steel" refers to what is commonly known as carbon steel, also called high-carbon steel, ordinary steel, straight carbon steel or plain carbon steel. Such steel owes its properties chiefly to the presence of carbon without substantial amounts of other alloying elements. However, the tensile strength of carbon steel can be increased by small additions of alloying elements, usually less than 1.0%, referred to as "micro-alloyed steels." High tensile strength steels having a high level of ductility and outstanding fatigue resistance are described in U.S. Pat. No. 4,960,473, which is incorporated herein by reference. Brass is an alloy of copper and zinc which can contain other metals in varying lesser amounts. The ternary alloys employed as coatings in this invention are iron-brass alloys since they contain 0.1 to 10 percent iron.

With reference to FIG. 1, the wire 12 may pass directly from each standard die 14 to its drawing capstan 16 and then to the next die. The wire 12 may be drawn over capstans 16 with each succeeding capstan running faster than the preceding one to compensate for wire elongation. The reduction in the cross sectional area of the wire between the capstans on this machine with a straight draft, may be a substantially fixed or standard value. This ensures a lower velocity of the wire being drawn than the peripheral velocity of the drawing capstans. The resulting positive slip ensures that all portions of the wire are taut and that there is adequate frictional force exerted on the wire by the capstan to pull the wire through the dies.

Figure 2:
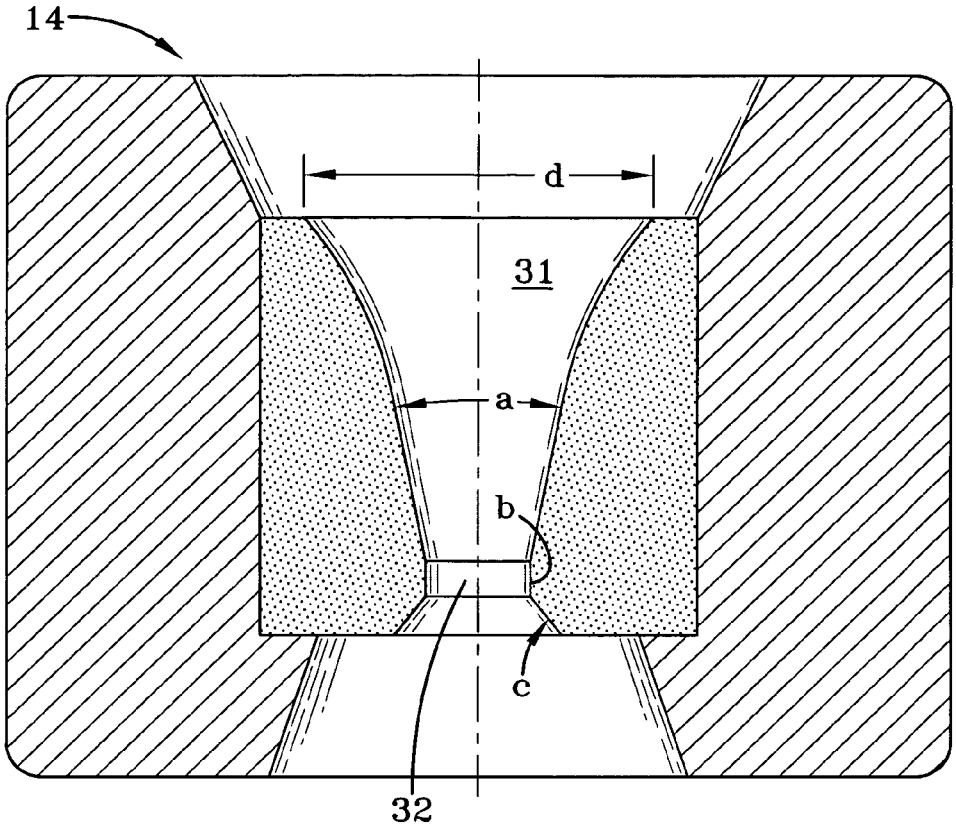
FIG. 2 is an enlarged side view of a standard die.

With reference to FIGS. 1 and 2, the die 14 may include a cavity that houses one or more inserts that reduce the cross section of the wire 12. The wire 12 may enter the die cavity from a first end and move along a first axis of travel through the die 14. As the wire 12 travels into the cavity, it encounters a wire reducing section 31. The cross section of the wire 12 may be reduced in the wire reducing section 31, by a predefined amount as will be discussed in the following paragraph. The wire 12 may then continue through the die 12 to a bearing region 32. In one embodiment, the final die, which may be a double die, may include two wire reducing sections 31, 31', reference FIG. 3, and two bearing regions 32, 32'. In this manner, the wire 12 is reduced twice within the same die 12 as will be discussed in detail in subsequent paragraph.

With reference to FIGS. 1 and 2, in one embodiment, reference FIG. 1, the wire 12 may be reduced by a constant amount of about 15% to about 18% at each standard die 14. Preferably, the cross section of the wire is reduced at each die 14 by an amount of about 15.5%. An important aspect of the invention is that the total reduction of the cross section of the wire at the final die 18' is substantially equal or less than the reduction at one of the preceding, standard dies. Preferably, the reduction in the next to last die 18 may be about 10% to about 90% of the constant reduction at the preceding, standard dies 14 and the remaining reduction is at the final die 19. More preferably, the reduction at next to final die 18 is about 30% to about 70% of the constant reduction and the remainder is at the final die 19. Most preferably, the reduction at the next to final die 18 is about 55% of the constant reduction and the remainder is at the final die 19. The last reduction in the cross sectional area of the wire within the next to last die 18 is preferably between 2% and 6%.

With reference to FIG. 2, a standard die 14 is shown having a die angle 'a', a bearing surface 'b', a back relief angle 'c' and an inlet opening diameter 'd'. Each standard die 14 may have a die angle 'a' of about 5 to about 12 degrees. For the purpose of the present invention, each die 14 may have a die angle of about 10 degrees. The final two dies 18 and 19 are substantially identical to the standard dies with the exception of the amount of reduction taken. Each of the final two dies may have a die angle of about 5 to about 12 degrees. Preferably, this die angle is about 10 degrees. The specific die angle 'a' in conjunction with the cross sectional areas of inlet opening 'd' and bearing surface 'b' controls the amount of reduction, as identified above, of the cross area of the wire as it passes through the die.

Figure 1A:
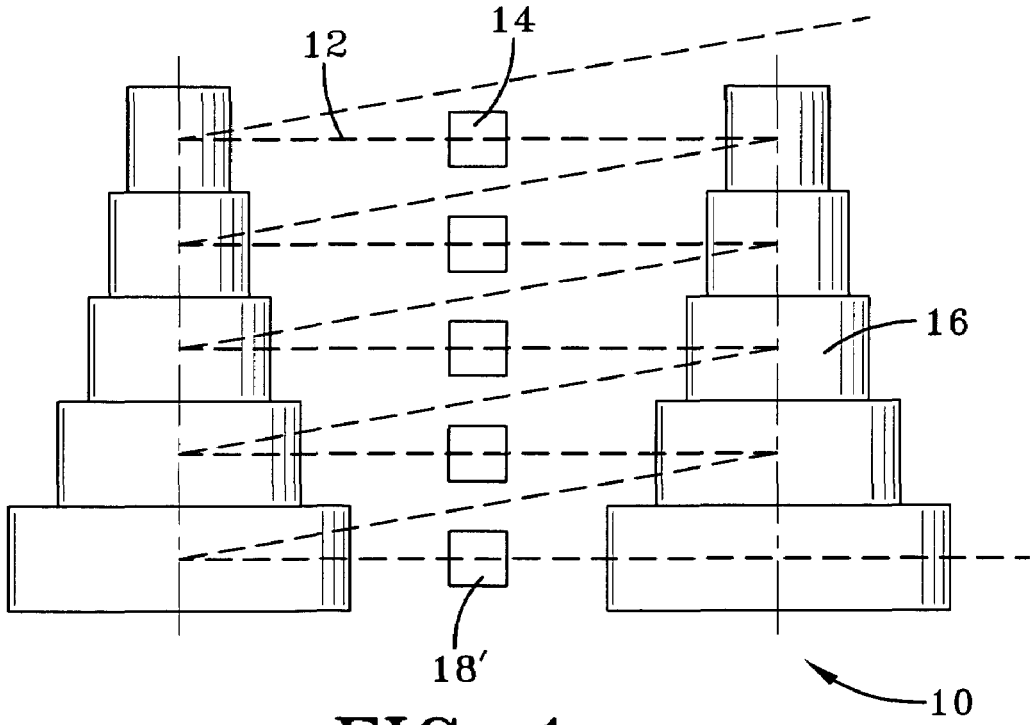
FIG. 1*a* is a schematic of drawing capstans and dies for drawing metal wire of the present invention.
Figure 3:
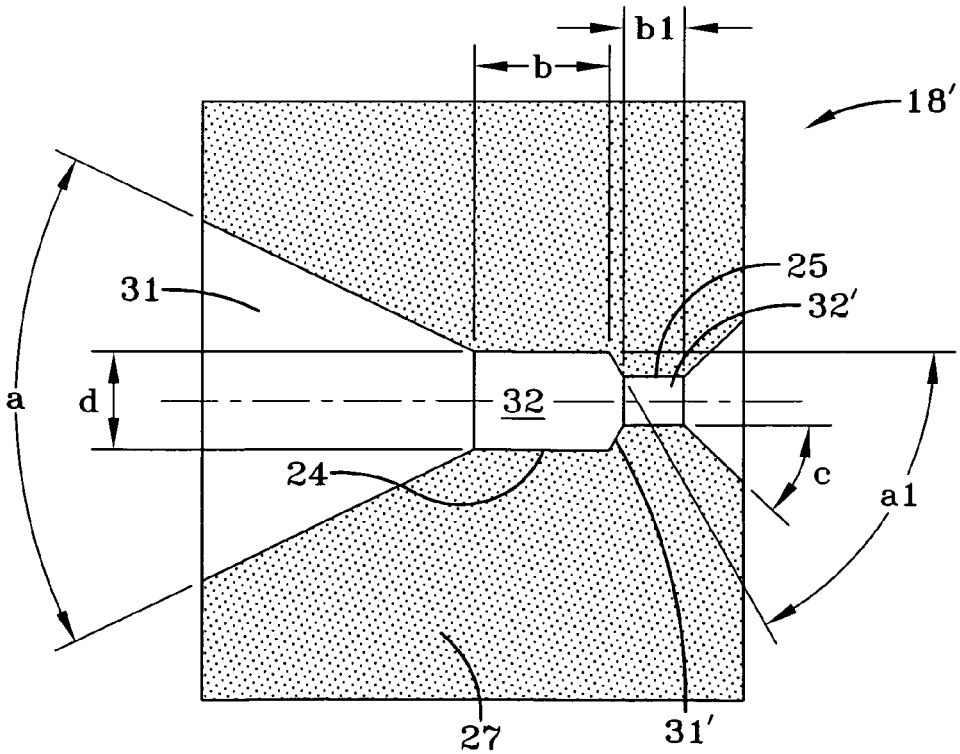
FIG. 3 is an enlarged side view of a double die having multiple inserts in a single die casing.

With reference to FIG. 1*a* and 3, in the present embodiment, the final two dies 18 and 19 may be incorporated into a single die casing 18', as shown in FIG. 1*a*. The final die may therefore be a single die facilitating two separate reductions of the wire 12, in one pass through the die 18', termed a double die 18'. FIG. 3 shows a schematic representation of the double die 18'. The die 18' may include multiple inserts or alternately may be fashioned from a single insert. The approach angle 'a' of the double die 18' may be equivalent to that of a standard die 14. As the wire 12 passes through the single die 18', the wire 12 may be reduced by the first wire reducing portion 31 and then immediately again by the second wire reducing portion 31'. A second approach angle 'a1' is shown in FIG. 3. As discussed above, the die angle 'a' and 'a1' may be about 5 to 12 degrees, and preferably 10 degrees. The last reduction in the cross sectional area of the wire within the double die 18' is preferably between 2% and 6%. In an embodiment, a die for drawing associated wire products has at least a first die portion having first and second ends, the at least a first die portion having cavity fashioned at least partially interior to the at least a first die portion for use in drawing an associated wire; wherein the cavity extends from the first end of the at least a first die portion to the second end; wherein the cavity includes at least first and second drawing contours for shaping the associated wire; and, wherein the at least a first drawing contour shapes the associated wire at a substantially similar rate as the at least a second extruding contour, wherein the associated wire travels through the cavity along a first axis; wherein the at least a first drawing contour is substantially conical, wherein the at least a first substantially conical contour forms an angle a with the first axis; and, wherein the angle a is between 5° and 12°, wherein the associated wire has an associated wire diameter D; and, further having a bearing region having a length b, wherein the length b is 0.3 the final diameter of the wire; further having a non-drawing relief contour being substantially conical, wherein the nonextruding relief contour forms an angle c with the first axis; and, wherein the angle c is between 20 and 35°.

With continued reference to FIGS. 1*a* and 3, the double die 18' may include a first bearing region 24 and a second bearing region 25. The first bearing region 24 may have a characteristic length 'b'. Similarly, the second bearing region 25 may have a characteristic length 'b1'. The lengths 'b' and 'b1' may be smaller than 0.3 times the wire diameter 'd'. In one embodiment, the lengths may equal 0.2 times the wire diameter. Alternately, the lengths 'b' and 'b1' may be greater than 0.6 times the wire diameter and preferably 0.7 times the wire diameter. This greatly reduces the delaminating affect on the wire 12 as it passes through the double die 18'. Further, region b may be equal to up to 50 times of the wire diameter.

Figure 4A:
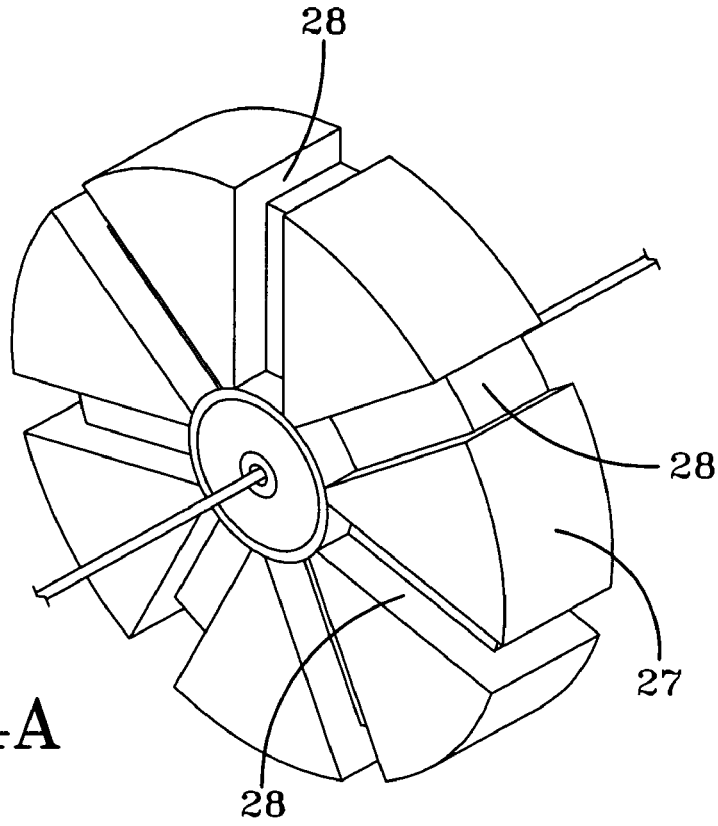
FIG. 4A is a perspective view of a die casing having heat dissipating grooves fashioned in the outer die casing surface.
Figure 4B:
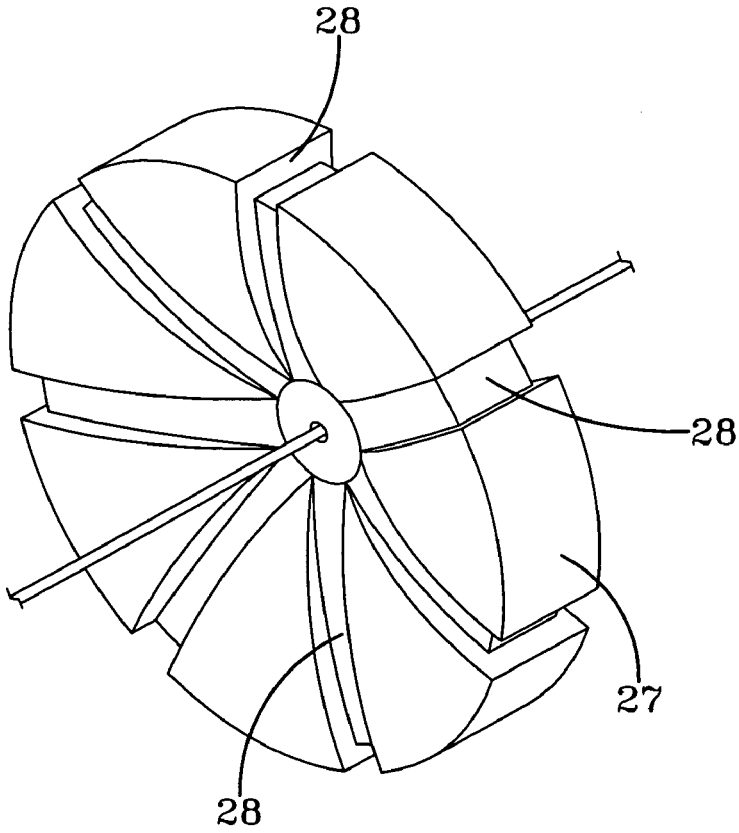
FIG. 4B is a perspective view of another embodiment of the die casing having heat dissipating grooves fashioned in the outer die casing surface.

With reference now to FIGS. 4A and 4B, another aspect of the present invention will now be discussed. The die casing 27 may have grooves 28 fashioned on the front and back faces of the casing 27. The grooves 28 may be cut into the outer surface of the die casing 27. However, any manner of fashioning grooves in the die casing may be chosen with sound engineering judgment. In one embodiment, the grooves 28 may be radially fashioned on the front and rear faces or surfaces of the die casing 27. These faces can be flat and have straight grooves, as shown in FIG. 4A, or these faces may be curved with curved grooves, as shown in FIG. 4B. In any manner, the grooves 28 provide the added capacity for the die casing 27 to dissipate heat generated from the wire reduction process. Further, axial grooves extend from the radial grooves. The radial grooves provided on the front and rear surfaces provide for lubrication between a tungsten-carbide insert and the wire 12. It is noted that the die casing may take any shape, including but not limited to star shaped, as chosen with good judgment to facilitate the dissipation of heat away from the die casing 27. The width W, length L, and depth D, of the grooves 28 may take any dimension as is necessary to increase the heat dissipating characteristics of the die casing over the traditional generally flat die surface.

While the present invention is directed to a wire drawing machine incorporating a straight draft, it is also within the terms of the present invention to substitute a wire drawing machine having a tapered draft. The advantage of a tapered draft is that the cross sectional area of the wire is reduced in a fewer number of dies. With a tapered draft, the amount of reduction in cross section of the wire would be larger at the first dies than with the dies in the constant draft. The amount of reduction at each draft would then become increasingly less until the last few dies. Based upon finite element analysis modeling, testing was performed to arrive at the results described herein.

It is apparent that there has been provided in accordance with this invention a method and apparatus of drawing metal wire to produce high tensile strength, steel wire with increased torsional ductility that satisfy the objects, means and advantages set forth hereinbefore. While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A die for drawing associated wire products, comprising:

at least a first die portion having first and second ends, the at least a first die portion having a cavity fashioned at least partially interior to the at least a first die portion for use in drawing an associated wire;

wherein the cavity extends from the first end of the at least a first die portion to the second end;

wherein the associated wire has an associated wire diameter d, wherein the associated wire travels through the cavity along a first axis;

wherein the cavity comprises:

a first drawing contour for reducing the cross-sectional area of the associated wire, wherein the first drawing contour is adjacent the first end of the first die portion. wherein the first drawing contour is substantially conical, wherein the first drawing contour forms an angle a with the first axis that is between 5 and 12 degrees, exclusive of 5 degrees;

a first bearing region having a length b that is less than 0.3 times the diameter d of the associated wire, wherein the first bearing region is adjacent the first drawing contour, wherein the first bearing region is substantially cylindrical;

a second drawing contour for reducing the cross-sectional area of the associated wire, wherein the second drawing contour is adjacent the first bearing region, wherein the second drawing contour is substantially conical, wherein the second drawing contour forms an angle a1 with the first axis that is between 5 and 12 degrees, exclusive of 5 degrees;

a second bearing region having a length b1 that is less than 0.3 times the diameter d of the associated wire, wherein the second bearing region is adjacent the second drawing contour, wherein the second bearing region is substantially cylindrical;

a non-drawing contour for use in guiding the associated wire through the second end of the at least a first die portion, wherein the non-drawing contour is adjacent the second bearing region, wherein the non-drawing contour is adjacent the second end of the first die portion, wherein the non-drawing contour is substantially conical, wherein the non-drawing contour forms an angle c with the first axis that is between 20 and 35 degrees;

wherein the first drawing contour, the first bearing region, the second drawing contour, the second bearing region, and the non-drawing contour are located within one die;

wherein the first bearing region is located between the first drawing contour and the second drawing contour, wherein the second bearing region is located between the second drawing contour and the non-drawing contour;

wherein the first drawing contour reduces the wire's first-contour-entering cross-sectional area by an amount ranging from about 1.5 to 16.2%;

wherein the second drawing contour reduces the wire's second-contour-entering cross-sectional area by an amount ranging from about 2% to 6%.

2. The die of claim 1, wherein the first drawing contour reduces the wire's first-contour-entering cross-sectional area by an amount ranging from about 4.5 to 12.6%.

3. The die of claim 1, wherein the first drawing contour reduces the wire's first-contour-entering cross-sectional area by an amount ranging from about 8.25 to 9.9%.

4. The die of claim 1, wherein the die further comprises:

a die casing surrounding the die, wherein the die casing has a first surface and a second surface, wherein at least one of the surfaces has at least one groove extending radially outward from the die.

5. The die of claim 4, wherein the die casing has a width, wherein the at least one groove extends radially outwardly to the outer edge of the die casing, and wherein at least one axial groove extends the width of the die casing, starting from the edge of the at least one radial groove.

6. The die of claim 5, wherein the die casing has at least one radial groove on both surfaces, wherein the surfaces can be either flat or rounded.

7. The die of claim 1, wherein the angle a is 10 degrees.

8. The die of claim 7, wherein the angle a1 is 10 degrees.

9. The die for drawing associated wire products, comprising:

a first die portion having first and second ends, the first die portion having a cavity fashioned at least partially interior to the at least a first die portion for use in drawing an associated wire;

wherein the cavity extends from the first end of the first die portion to the second end;

wherein the associated wire has an associated wire diameter d, wherein the associated wire travels through the cavity along a first axis;

wherein the cavity comprises:

a first drawing contour for reducing the cross-sectional area of the associated wire, wherein the first drawing contour is adjacent the first end of the first die portion, wherein the first drawing contour is substantially conical, wherein the first drawing contour forms an angle a with the first axis that is between 5 and 12 degrees, exclusive of 5 degrees;

a first bearing region having a length b that is one to fifty times the diameter d of the associated wire, wherein the first bearing region is adjacent the first drawing contour, wherein the first bearing region is substantially cylindrical;

a second drawing contour for reducing the cross-sectional area of the associated wire, wherein the second drawing contour is adjacent the first bearing region, wherein the second drawing contour is substantially conical, wherein the second drawing contour forms an angle a1 with the first axis that is between 5 and 12 degrees, exclusive of 5 degrees;

a second bearing region having a length b1 that is one to fifty times the diameter d of the associated wire, wherein the second bearing region is adjacent the second drawing contour, wherein the second bearing region is substantially cylindrical;

a non-drawing contour for use in guiding the associated wire through the second end of the at least a first die portion, wherein the non-drawing contour is adjacent the second bearing region, wherein the non-drawing contour is adjacent the second end of the first die portion, wherein the non-drawing contour is substantially conical, wherein the non-drawing contour forms an angle c with the first axis that is between 20 and 35 degrees;

wherein the first drawing contour, the first bearing region, the second drawing contour, the second bearing region, and the non-drawing contour are located within one die;

wherein the first bearing region is located between the first drawing contour and the second drawing contour, wherein the second bearing region is located between the second drawing contour and the non-drawing contour;

wherein the first drawing contour reduces the wire's first-contour-entering cross-sectional area by an amount ranging from about 1.5 to 16.2%;

wherein the second drawing contour reduces the wire's second-contour-entering cross-sectional area by an amount ranging from about 2 to 6%.

10. The die of claim 9, wherein the first drawing contour reduces the wire's first-contour-entering cross-sectional area by an amount ranging from about 4.5 to 12.6%.

11. The die of claim 9, wherein the first drawing contour reduces the wire's first-contour-entering cross-sectional area by an amount ranging from about 8.25 to 9.9%.

12. The die of claim 9, wherein the die further comprises:

a die casing surrounding the die, wherein the die casing has a first surface and a second surface, wherein at least one of the surfaces has at least one groove extending radially outward from the die.

13. The die of claim 12, wherein the die casing has a width, wherein the at least one groove extends radially outwardly to the outer edge of the die casing, and wherein at least one axial groove extends the width of the die casing, starting from the edge of the at least one radial groove.

14. The die of claim 13, wherein the die casing has at least one radial groove on both surfaces, wherein the surfaces can be either flat or rounded.

15. The die of claim 9, wherein the length b is ten to fifty times the diameter d of the associated wire, and wherein the length b1 is ten to fifty times the diameter d of the associated wire.

16. The die of claim 9, wherein the length b is twenty to fifty times the diameter d of the associated wire, and wherein the length b1 is ten to fifty times the diameter d of the associated wire.

* * * * *